US008882530B2

(12) United States Patent
Matsumura et al.

(10) Patent No.: US 8,882,530 B2
(45) Date of Patent: Nov. 11, 2014

(54) LEVER FITTING-TYPE CONNECTOR

(75) Inventors: Kaoru Matsumura, Makinohara (JP); Kazuto Ohtaka, Makinohara (JP); Hideki Homma, Tokyo (JP); Tetsuya Mitani, Wako (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 59 days.

(21) Appl. No.: 13/704,330

(22) PCT Filed: Jun. 16, 2011

(86) PCT No.: PCT/JP2011/063831

§ 371 (c)(1),
(2), (4) Date: Dec. 14, 2012

(87) PCT Pub. No.: WO2011/158910

PCT Pub. Date: Dec. 22, 2011

(65) Prior Publication Data

US 2013/0084729 A1 Apr. 4, 2013

(30) Foreign Application Priority Data

Jun. 16, 2010 (JP) ..... 2010-137276

(51) Int. Cl.

| | |
|---|---|
| ***H01R 13/62*** | (2006.01) |
| ***H01R 13/629*** | (2006.01) |
| *H01R 13/514* | (2006.01) |
| *H01R 13/516* | (2006.01) |

(52) U.S. Cl.

CPC ..... *H01R 13/62977* (2013.01); *H01R 13/514* (2013.01); *H01R 13/516* (2013.01)

USPC ..... 439/372; 439/701

(58) Field of Classification Search

CPC ..... H01R 13/514; H01R 13/62938; H01R 13/62933; H01R 13/6295; H01R 13/62944; H01R 13/62955

USPC ..... 439/372, 157, 701

See application file for complete search history.

(56) References Cited

U.S. PATENT DOCUMENTS 3,537,061 A * 10/1970 Haag et al. ..... 439/518
3,848,951 A * 11/1974 Michaels et al. ..... 439/357

(Continued)

FOREIGN PATENT DOCUMENTS

JP 6310200 A 11/1994
JP 8106949 A 4/1996

(Continued)

OTHER PUBLICATIONS

International Search Report dated Jul. 12, 2011 issued in International Application No. PCT/JP2011/063831 (PCT/ISA/210).

(Continued)

*Primary Examiner* — Ross Gushi
(74) *Attorney, Agent, or Firm* — Sughrue Mion, PLLC

(57) ABSTRACT

Provided is a lever fitting-type connector wherein the time for connecting a second connector comprised of a plurality of connector segments to a first connector can be reduced; and a compact connector portion of a wire harness can be obtained. A second connector (14) fitted and connected to a first connector (13) by an operation for rotating a fitting operation lever (15) attached to the first connector (13), is configured by combining a main connector segment (31) with a subsidiary connector segment (32). The main connector segment (31) has a lever engagement portion (34) to be engaged with the fitting operation lever (15) when the main connector segment is fitted to an initial fitting position. The main connector segment (31) is shifted from the initial fitting position to a complete fitting position by an operation for rotating the fitting operation lever (15).

2 Claims, 19 Drawing Sheets

(56) References Cited

U.S. PATENT DOCUMENTS

| | | | | |
|---|---|---|---|---|
| 4,425,018 | A * | 1/1984 | Stenz | 439/716 |
| 4,469,393 | A * | 9/1984 | Chewning et al. | 439/717 |
| 5,288,250 | A * | 2/1994 | Sumida | 439/701 |
| 5,288,251 | A * | 2/1994 | Sumida | 439/701 |
| 5,454,733 | A | 10/1995 | Watanabe et al. | |
| 5,643,015 | A * | 7/1997 | Wakata | 439/701 |
| 5,725,397 | A * | 3/1998 | Fukamachi et al. | 439/701 |
| 5,855,486 | A | 1/1999 | Fukamachi et al. | |
| 5,895,296 | A * | 4/1999 | Okabe | 439/701 |
| 5,904,598 | A * | 5/1999 | Yamanashi | 439/701 |
| 5,938,481 | A * | 8/1999 | Okabe et al. | 439/748 |
| 6,017,250 | A * | 1/2000 | Tsuji et al. | 439/701 |
| 6,155,884 | A * | 12/2000 | Sugiyama | 439/701 |
| 6,193,550 | B1 * | 2/2001 | Yamashita et al. | 439/594 |
| 6,332,788 | B1 * | 12/2001 | Okabe et al. | 439/157 |
| 6,332,813 | B1 * | 12/2001 | Okabe et al. | 439/701 |
| 6,375,517 | B1 * | 4/2002 | Okabe et al. | 439/701 |
| 6,447,344 | B2 * | 9/2002 | Sato et al. | 439/701 |
| 6,575,794 | B1 * | 6/2003 | Nakamura | 439/701 |
| 6,619,996 | B2 * | 9/2003 | Hara et al. | 439/701 |
| 6,638,108 | B2 * | 10/2003 | Tachi | 439/595 |
| 6,685,496 | B2 * | 2/2004 | Ookura | 439/372 |
| 6,796,815 | B2 * | 9/2004 | Okabe et al. | 439/157 |
| 6,881,100 | B2 * | 4/2005 | Barry et al. | 439/701 |
| 6,976,887 | B2 * | 12/2005 | Shigeta et al. | 439/717 |
| 6,984,149 | B2 * | 1/2006 | Fukuda et al. | 439/587 |
| 7,347,744 | B2 * | 3/2008 | Tabata et al. | 439/752 |
| 7,404,744 | B2 * | 7/2008 | Amano et al. | 439/701 |
| 7,625,250 | B2 * | 12/2009 | Blackwell | 439/717 |
| 7,717,757 | B2 * | 5/2010 | Yamada et al. | 439/701 |
| 7,775,815 | B2 * | 8/2010 | Takahashi et al. | 439/157 |
| 7,828,583 | B2 * | 11/2010 | Ohsumi et al. | 439/374 |
| 7,837,515 | B2 * | 11/2010 | Takahashi et al. | 439/701 |
| 7,878,825 | B2 * | 2/2011 | Matsumura | 439/157 |
| 7,963,781 | B2 * | 6/2011 | Takahashi et al. | 439/157 |
| 7,976,332 | B2 * | 7/2011 | Matsumura et al. | 439/374 |
| 8,043,127 | B2 * | 10/2011 | Bailey et al. | 439/701 |
| 8,079,882 | B2 * | 12/2011 | Bailey et al. | 439/717 |
| 2002/0052152 | A1 * | 5/2002 | Sakurai et al. | 439/701 |
| 2005/0142912 | A1 | 6/2005 | Shigeta et al. | |
| 2006/0030222 | A1 * | 2/2006 | Fan | 439/684 |
| 2009/0197448 | A1 * | 8/2009 | Takahashi et al. | 439/217 |
| 2009/0203240 | A1 * | 8/2009 | Matsumura et al. | 439/153 |
| 2009/0203251 | A1 * | 8/2009 | Takahashi et al. | 439/376 |
| 2009/0253282 | A1 * | 10/2009 | Takahashi et al. | 439/259 |
| 2009/0325411 | A1 * | 12/2009 | Matsumura | 439/157 |
| 2010/0099295 | A1 * | 4/2010 | Ohsumi et al. | 439/374 |
| 2010/0210127 | A1 * | 8/2010 | Matsumura et al. | 439/157 |
| 2010/0248528 | A1 * | 9/2010 | Matsumura et al. | 439/374 |
| 2013/0084729 | A1 * | 4/2013 | Matsumura et al. | 439/341 |
| 2014/0106585 | A1 * | 4/2014 | Shimizu et al. | 439/157 |

FOREIGN PATENT DOCUMENTS

| | | | |
|---|---|---|---|
| JP | 10241786 | A | 9/1998 |
| JP | 2000228247 | A | 8/2000 |
| JP | 2005166278 | A | 6/2005 |

OTHER PUBLICATIONS

Written Opinion dated Jul. 12, 2011 issued in International Application No. PCT/JP2011/063831 (PCT/ISA/237).

Chinese Office Action dated Aug. 1, 2014 issued by The Intellectual Property Office of the People's Republic of China in counterpart Chinese application No. 201180029779.4.

* cited by examiner

LEVER FITTING-TYPE CONNECTOR

TECHNICAL FIELD

The invention relates to a lever fitting-type connector, and more particularly, to improvements on a lever fitting-type connection having one connector consisting of a plurality of connector segments.

BACKGROUND ART

FIG. 19 shows a conventional example of a lever fitting-type connector.

A lever fitting-type connector 10 shown in FIG. 19 is described in Patent Document 1 and includes a first connector 1, a second connector 2 consisting of a plurality of connector segments 2*a*, 2*b*, 2*c* and fitted and connected to the first connector 1 and a fitting operation lever 3 rotatably attached to the first connector 1.

The first connector 1 has a plurality of segment receiving portions 1*a*, 1*b*, 1*c* corresponding to the respective connector segments 2*a*, 2*b*, 2*c* of the second connector 2.

The respective connector segments 2*a*, 2*b*, 2*c* are independent connectors and have lever engagement portions 4*a*, 4*b*, 4*c* that can be engaged with the fitting operation lever 3 when the connector segments are fitted to an initial fitting position of the first connector 1 and protrude from both sides thereof, respectively.

The fitting operation lever 3 has connector draw-in grooves 5*a*, 5*b*, 5*c* into which the lever engagement portions 4*a*, 4*b*, 4*c* of the respective connector segments 2*a*, 2*b*, 2*c* fitted at the initial fitting position of the first connector 1 are fitted. When the fitting operation lever 3 is rotated in a predetermined direction (refer to an arrow A of FIG. 19) by a predetermined angle with the second connector 2 being fitted at the initial fitting position of the first connector 1, the respective fitting engagement portions 4*a*, 4*b*, 4*c* are slid in the connector draw-in grooves 5*a*, 5*b*, 5*c* as the fitting operation lever 3 is rotated, thereby moving the respective connector segments 2*a*, 2*b*, 2*c* from the initial fitting position to a complete fitting position.

Also, although not shown, Patent Document 2 and Patent Document 3 disclose a lever fitting-type connector wherein a first connector having a fitting operation lever attached thereto consists of a plurality of connector segments and the connector segments are combined to function as a single connector. Also, according to the lever fitting-type connector of Patent Document 2 and Patent Document 3, a second connector that is connected to the first connector has an integral structure.

According to the lever fitting-type connector disclosed in Patent Documents 1 to 3, regarding the connector consisting of the plurality of connector segments, a connector segment that is actually used is selected (an unnecessary connector segment is not used), so that the number of accommodation terminals can be adjusted.

TECHNICAL DOCUMENTS

Patent Documents

[Patent Document 1] JP-A-10-241786

[Patent Document 2] JP-A-2000-228247

[Patent Document 3] JP-A-2005-166278

SUMMARY OF THE INVENTION

Problems to be Solved

However, according to the lever fitting-type connector 10, the plurality of connector segments 2*a*, 2*b*, 2*c* configuring the second connector 2 cannot be combined, so that they should be individually fitted to the first connector 1.

Therefore, when fitting the plurality of connector segments 2*a*, 2*b*, 2*c* to the first connector 1, much time and effort are consumed.

Also, according to the lever fitting-type connector disclosed in Patent Document 2 or Patent Document 3, the connector consisting of the plurality of connector segments is the first connector to which the fitting operation lever is attached. Therefore, even when a part of the connector segments is detached because it is preferable that the number of accommodation terminals is small, the fitting operation lever is left. Thus, an outward appearance of the first connector is not so much changed (reduced).

Therefore, even when the first connector consisting of the plurality of connector segments is attached to a wire harness, it is not possible to obtain a compact connector portion of the wire harness.

Also, Patent Documents 1 to 3 do not disclose or suggest a technology of preventing the fitting operation lever from being unintentionally rotated before one connector is fitted to the initial fitting position of the other connector and a technology of enabling an operator to simply confirm that one connector is fitted to the initial fitting position of the other connector.

Therefore, the fitting operation lever is unintentionally rotated, so that it may not be possible to smoothly fit and connect the connectors each other. Also, an operator may erroneously operate the fitting operation lever before one connector reaches the initial fitting position of the other connector.

Accordingly, the invention has been made to solve the above problems. An object of the invention is to provide a lever fitting type connector capable of reducing time and effort for connecting a second connector consisting of a plurality of connector segments to a first connector and attaching the second connector to a wire harness to thus obtain a compact connector portion of the wire harness.

Means for Solving the Problems

The above object is achieved by following configurations.

(1) A lever fitting type connector comprising a first connector, a second connector that is configured to adjust the number of accommodation terminals by combining and separating a plurality of connector segments and is fitted and connected to the first connector, and a fitting operation lever that is rotatably provided to the first connector and moves the second connector from an initial fitting position of the first connector to a complete fitting position as the fitting operation lever is rotated in a predetermined direction by a predetermined angle at a state where the second connector is fitted at the initial fitting position, wherein the second connector comprises a main connector segment that has a lever engagement portion, which is engaged with the fitting operation lever when the main connector segment is fitted to the initial fitting position, and is moved from the initial fitting position to the complete fitting position by an operation for rotating the fitting operation lever, and a subsidiary connector segment that is combined with the main connector segment and is moved from the initial fitting position to the complete fitting position together with the main connector segment.

(2) The lever fitting type connector of the above (1) further comprises a lever engagement arm that temporarily fixes the fitting operation lever rotatably mounted to the first connector to an initial position at which the fitting operation lever can be engaged with the lever engagement portion on the main connector segment fitted at the initial fitting position, and an engagement release rib that is integrally formed with the main connector segment and releases the temporary fixing of the fitting operation lever by the lever engagement arm when the main connector segment is fitted to the initial fitting position, thereby enabling the fitting operation lever to be rotated in the predetermined direction.

(3) In the lever fitting type connector of (2), the lever engagement arm is provided so that a state where the fitting operation lever is temporarily fixed at the initial position and a state where the temporary fixing state is released can be discriminated with naked eyes.

According to the above (1) configuration, the main connector segment and the subsidiary connector segment, which configure the second connector, are combined, which can be then fitted to the first connector, as a single connector. Therefore, it is not necessary to perform a troublesome operation of individually fitting the individual connector segments to the first connector. Hence, it is possible to reduce the time and effort for connecting the second connector consisting of the plurality of connector segments to the first connector.

Also, if the number of core lines of a wire harness is small when attaching the second connector to the wire harness, it is possible to reduce an outward appearance size of the connector by removing the unnecessary subsidiary connector segment of the second connector, for example. Thereby, it is possible to obtain a compact connector portion of the wire harness.

According to the above (2) configuration, the fitting operation lever on the first connector is temporarily fixed at the initial position by the lever engagement arm until the second connector is fitted to the initial fitting position of the first connector, so that the fitting operation lever is prevented from being unintentionally rotated. Therefore, a case does not occur in which an operator erroneously operates the fitting operation lever.

When the second connector is fitted to the initial fitting position of the first connector, the temporary fixing by the lever engagement arm is released by the engagement release rib provided to the main connector segment of the second connector. Thus, the fitting operation lever engaged with the lever engagement portion of the main connector segment can be rotated. By rotating the fitting operation lever in the predetermined direction by the predetermined angle, it is possible to move the main connector segment and the subsidiary connector segment combined with the main connector segment from the initial fitting position of the first connector to the complete fitting position.

Therefore, it is possible to smoothly fit and connect the second connector and the first connector.

According to the above (3) configuration, an operator can simply discriminate whether the fitting operation lever is at the state where the second connector is normally fitted to the initial fitting position of the first connector and the temporary fixing of the fitting operation lever is thus released or at the state where the fitting of the second connector to the initial fitting position is not completed yet and thus the temporary fixing state of the fitting operation lever continues, by checking the status of the lever engagement arm with naked eyes.

Hence, when connecting the connectors each other, the operator can easily detect that the second connector is normally fitted to the initial fitting position of the first connector and thus can rotate the fitting operation lever at ease to thus smoothly perform the operation, just by checking the status of the lever engagement arm with naked eyes without examining the insertion state of the second connector.

EMBODIMENT FOR CARRYING OUT THE INVENTION

Hereinafter, preferred illustrative embodiments of the lever fitting type connector of the invention will be specifically described with reference to the accompanying drawings.

Figure 1:
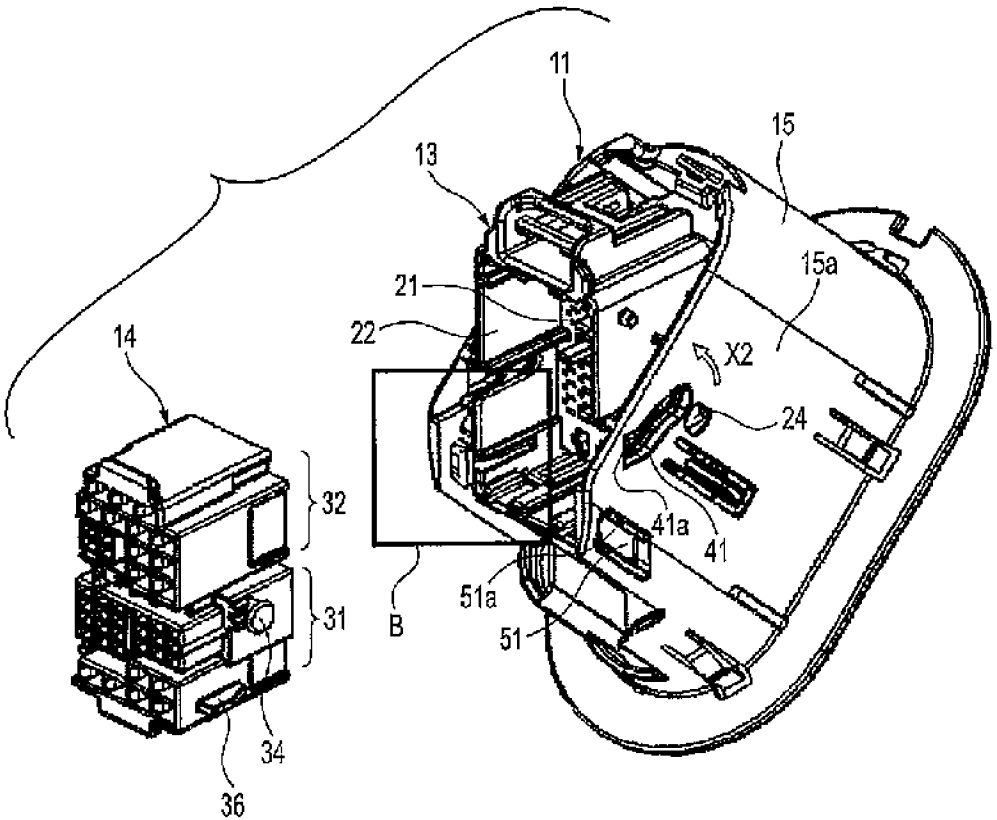
FIG. 1 is an exploded perspective view of a lever fitting type connector according to an illustrative embodiment of the invention.
Figure 2:
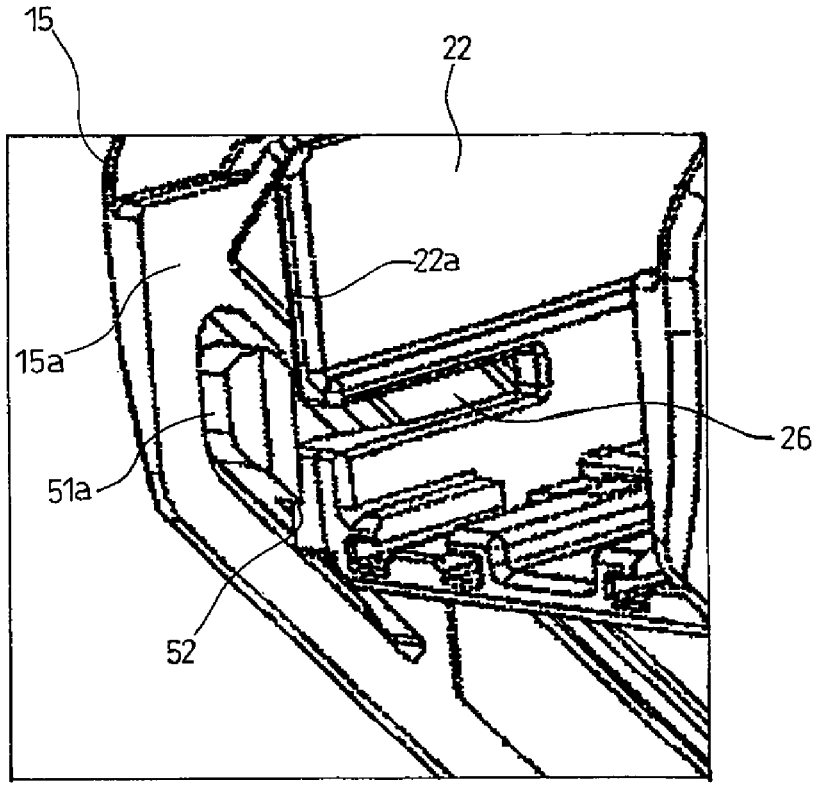
FIG. 2 is an enlarged view of a B part shown in FIG. 1.
Figure 3:
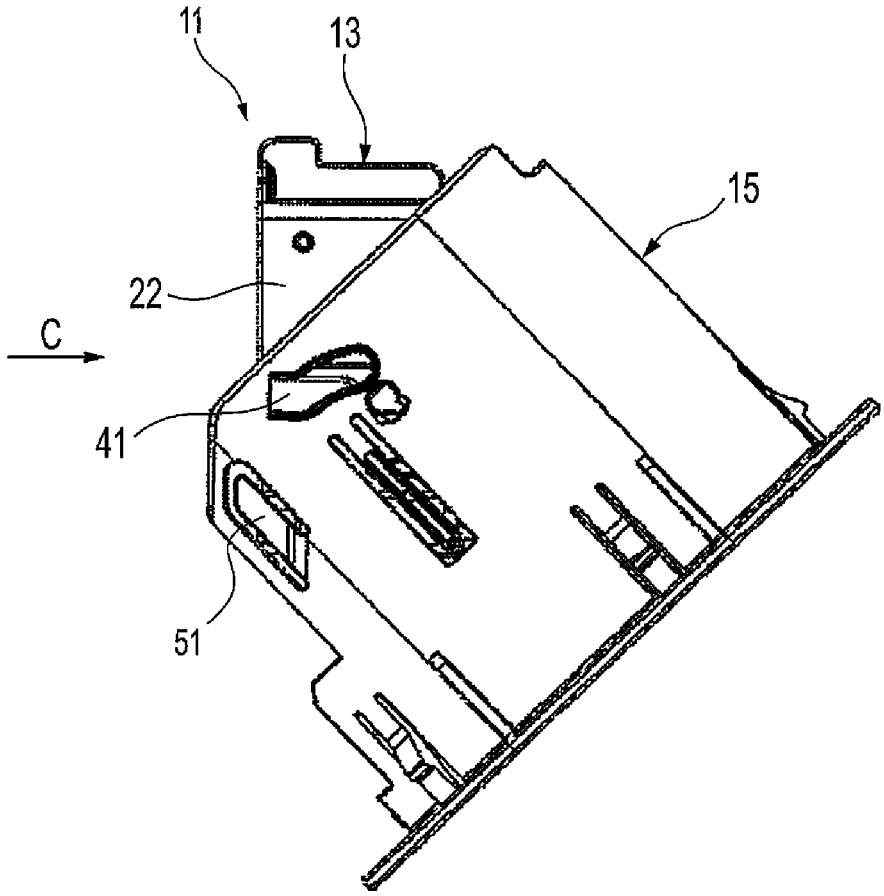
FIG. 3 is a side view of a first connector shown in FIG. 2.
Figure 4:
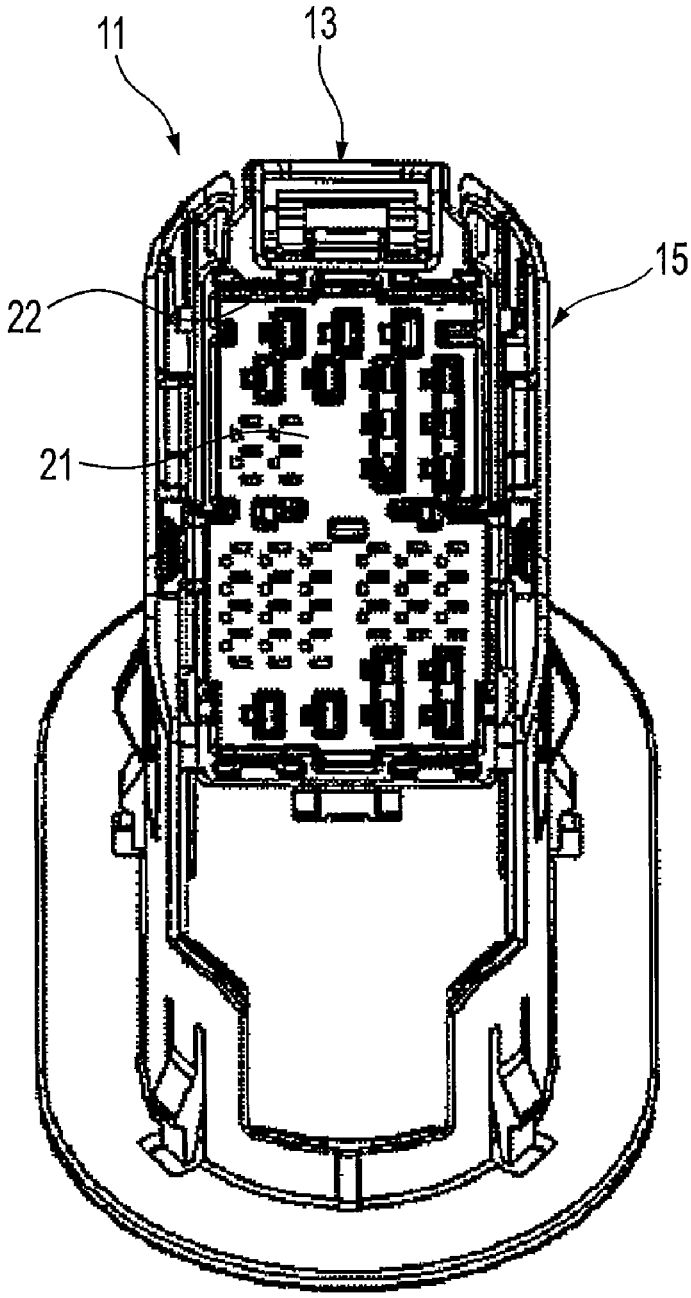
FIG. 4 is a view seen from an arrow C direction of FIG. 3.

FIG. 1 is an exploded perspective view of a lever fitting type connector according to an illustrative embodiment of the invention, FIG. 2 is an enlarged view of a B part shown in FIG. 1, FIG. 3 is a side view of a first connector shown in FIG. 2 and FIG. 4 is a view seen from an arrow C direction of FIG. 3.

As shown in FIG. 1, a lever fitting type connector 11 according to an illustrative embodiment of the invention has a first connector 13, a second connector 14 and a fitting operation lever 15 that is rotatably attached to the first connector 13.

In this illustrative embodiment, the first connector 13 is a male connector having a male terminal accommodation portion 21 that arranges and accommodates a plurality of male terminals (not shown) and a hood portion 22 to which the second connector 14 is fitted. The hood portion 22 has a frame shape surrounding an outer circumference of the second connector 14.

The second connector 14 is a female connector that arranges and accommodates female terminals (not shown) to be fitted and connected to the male terminals accommodated in the first connector 13 and is fitted to the hood portion 22.

The second connector 14 can be fitted to an initial fitting position and a complete fitting position of the first connector 13.

Here, the complete fitting position is a position at which the second connector 14 is inserted into the first connector 13 by a predetermined length and the mutual fitting and connection of the terminals in the respective connectors is completed.

Compared to this, the initial fitting position is a position at which an insertion depth of the second connector 14 into the first connector is shallow and the terminals in the respective connectors are not fitted yet each other. An insertion operation of fitting the second connector 14 to the initial fitting position can be made with a small operating force because the terminals are not fitted yet each other.

The second connector 14 is moved from the initial fitting position to the complete fitting position by an operation for rotating the fitting operation lever 15, which will be described later.

In this illustrative embodiment, the second connector 14 is configured to adjust the number of accommodation terminals by combining and separating a main connector segment 31 and a subsidiary connector segment 32, which are the plurality of connector segments. In this illustrative embodiment, the main connector segment 31 has lever engagement portions 34.

The lever engagement portions 34 provided to the main connector segment 31 are protrusions (boss portions) that are engaged into connector draw-in grooves 41 of the fitting operation lever 15 (which will be described later) when the second connector 14 is fitted to the initial fitting position of the first connector 13. The lever engagement portions 34 are respectively provided on both side surfaces of the main connector segment 31.

Figure 5:
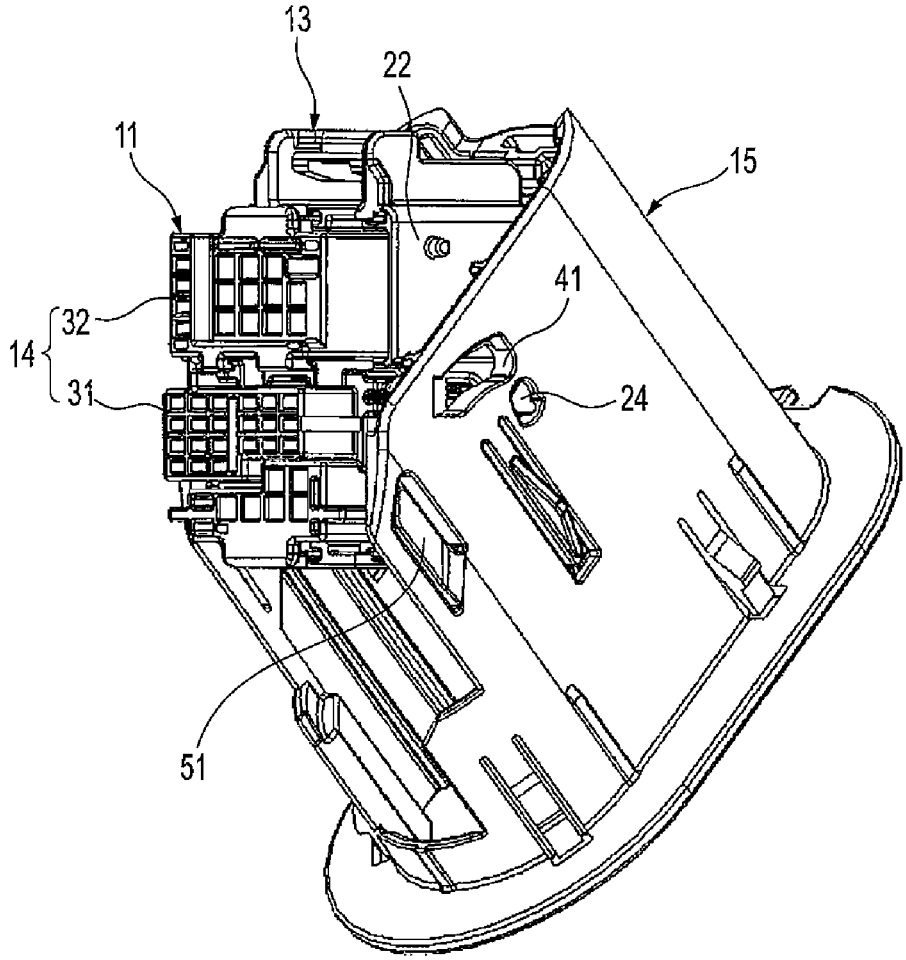
FIG. 5 is a perspective view showing a state where a second connector shown in FIG. 1 is fitted to a front of an initial fitting position of the first connector.
Figure 6:
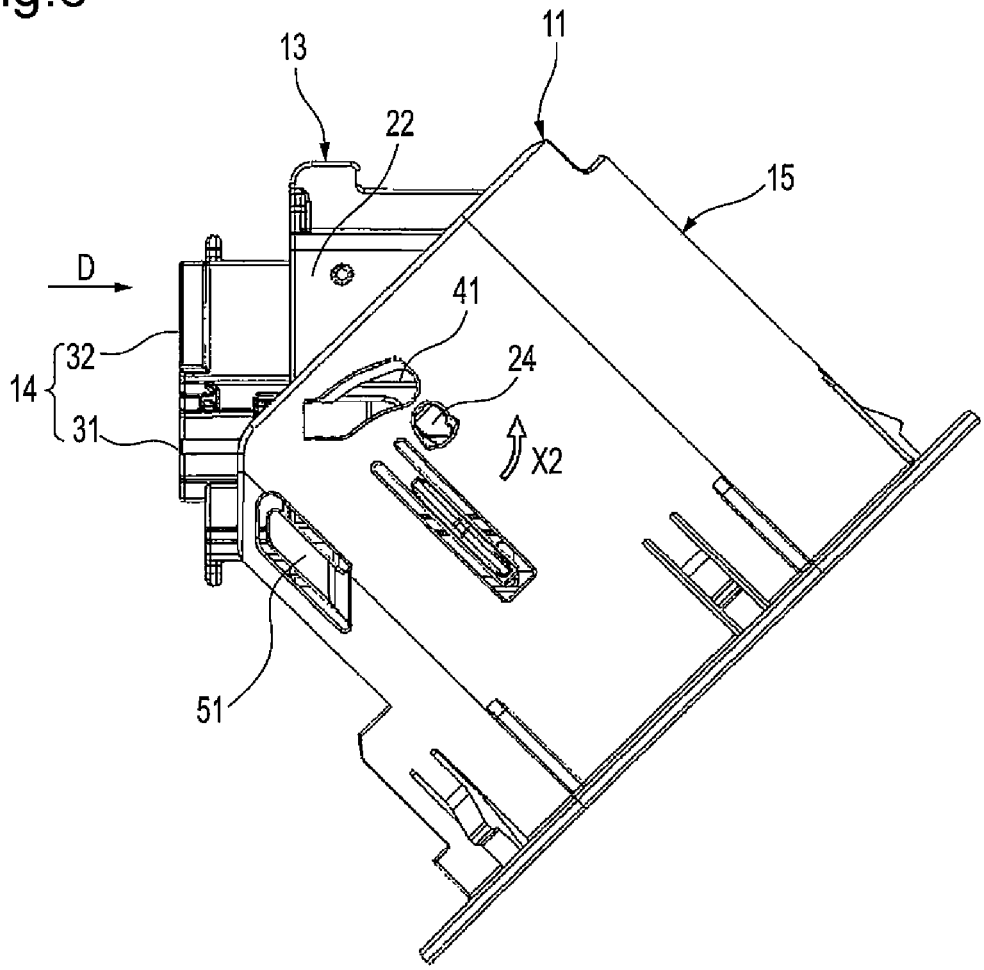
FIG. 6 is a side view of a lever fitting type connector shown in FIG. 5.
Figure 7:
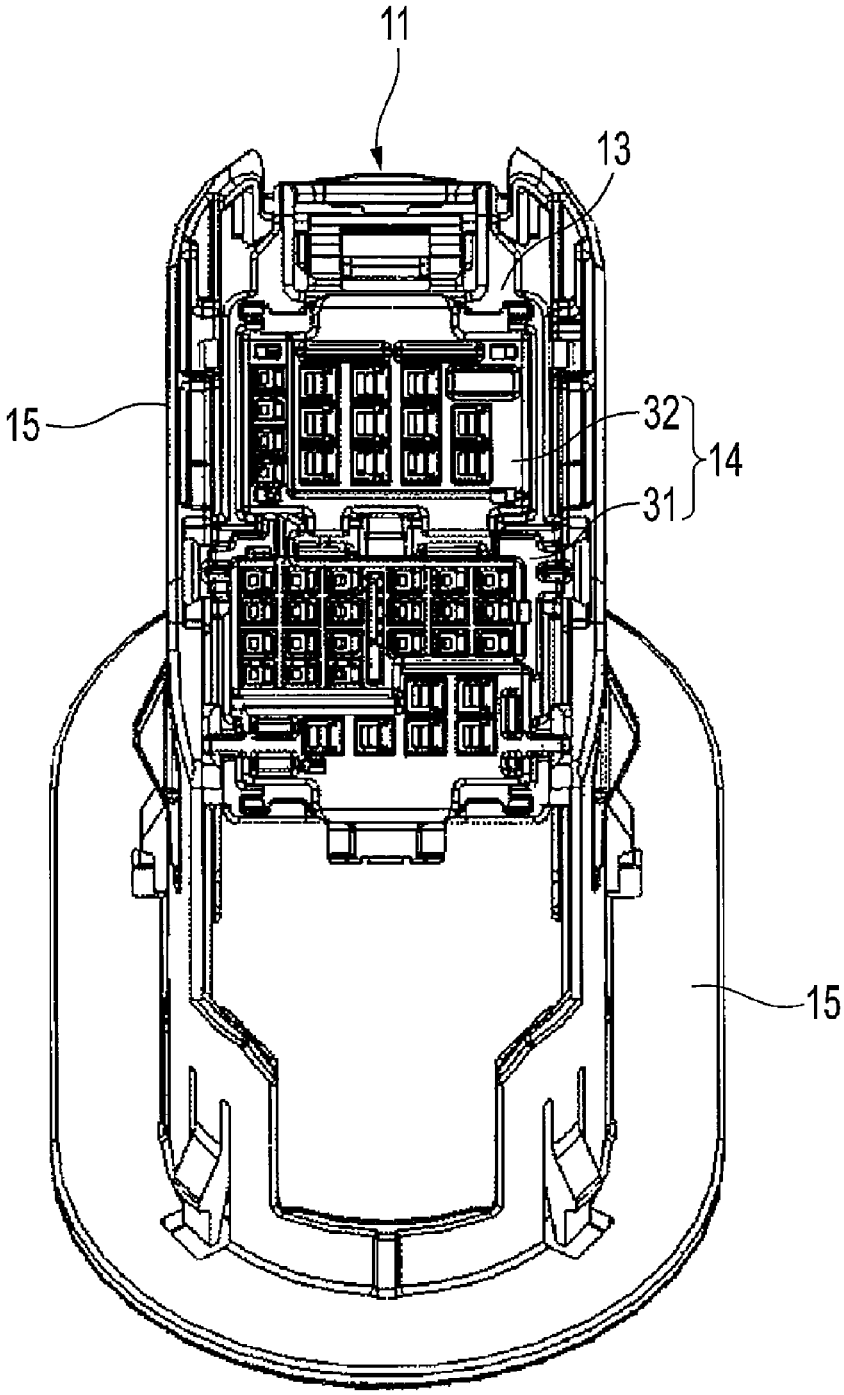
FIG. 7 is a view seen from an arrow D direction of FIG. 6.

FIGS. 5 to 7 show a state where the second connector 14 is fitted to a front of the initial fitting position of the first connector 13. Like this, at a state where the insertion depth of the second connector 14 into the first connector 13 is shallow and the second connector 14 does not reach the initial fitting position, the lever engagement portions 34 do not reach the connector draw-in grooves 41 and thus the lever engagement portions 34 and the connector draw-in grooves 41 are not engaged yet.

FIGS. 8 to 11 show a state where the second connector 14 is completely fitted to the initial fitting position of the first connector 13. When the second connector 14 reaches the initial fitting position of the first connector 13, the lever engagement portions 34 are engaged to beginning ends 41*a* of the connector draw-in grooves 41, as shown.

When the fitting operation lever 15 is rotated in a predetermined direction by a predetermined angle at the state where the lever engagement portions 34 are engaged into the connector draw-in grooves 41, it is possible to move the second connector 14 from the initial fitting position to the complete fitting position.

Figure 15:
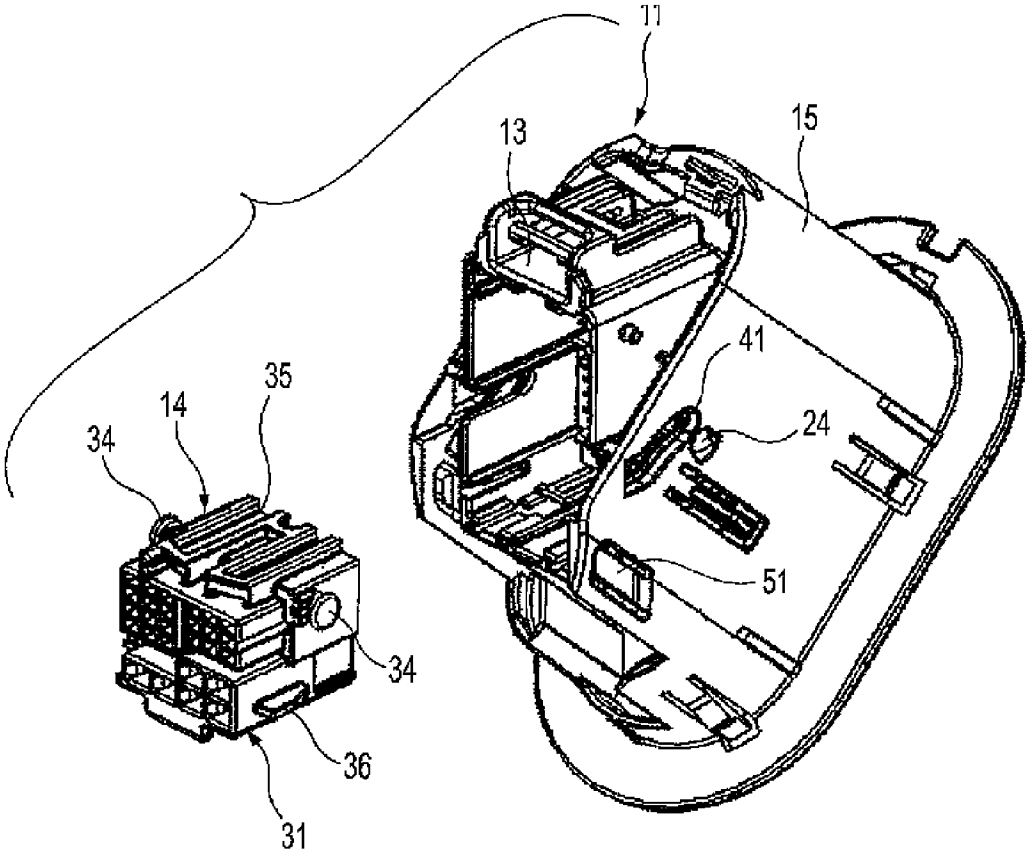
FIG. 15 is an exploded perspective view showing a configuration where the second connector consists of only a main connector segment in the lever fitting type connector shown in FIG. 1.

As shown in FIG. 1, the subsidiary connector segment 32 is a connector segment that is combined with the main connector segment 31 by an engagement structure (not shown) (a part thereof is shown in FIG. 15) and is moved from the initial fitting position to the complete fitting position together with the main connector segment 31.

The subsidiary connector segment 32 is not provided with the lever engagement portions 34 to be engaged with the fitting operation lever 15 and is fitted to the first connector 13 with being combined with the main connector segment 31.

In this illustrative embodiment, the subsidiary connector segment 32 is combined with the main connector segment 31 with a lower surface thereof being closely contacted to an upper surface of the main connector segment 31. The lower surface of the subsidiary connector segment 32 and the upper surface of the main connector segment 31 are provided with engagement structures for connecting and combining the connector segments each other.

Also, FIG. 15 shows an engagement structure 35 that is provided on the upper surface of the main connector segment 31 so as to connect and combine the subsidiary connector segment 32.

The fitting operation lever 15 is rotatably mounted to pivot portions 24 that are provided on both side surfaces of the first connector 13. As shown in FIGS. 8 to 11, the fitting operation lever 15 moves the second connector 14 from the initial fitting position to the complete fitting position by the connector draw-in grooves 41 when the fitting operation lever is rotated about the pivot portions 24 in a predetermined direction (arrow X1 direction in FIG. 10) by a predetermined angle with the second connector 14 being fitted at the initial fitting position of the first connector 13.

In this illustrative embodiment, as shown in FIG. 1, the fitting operation lever 15 is provided with lever engagement arms 51 and the main connector segment 31 of the second connector 14 is provided with engagement release ribs 36.

As shown in FIGS. 2 and 7, the lever engagement arm 51 is integrally formed on a side wall 15*a* of the fitting operation lever 15 so that a tip 51*a* thereof protrudes in front of a front end surface 22*a* of the hood portion 22 of the first connector 13. As shown in FIG. 2, the lever engagement arm 51 temporarily fixes the fitting operation lever 15, which is rotatably mounted to the first connector 13, to an initial position by engaging a step 52 formed at an inner side of the tip 51*a* with the front end surface 22*a* of the hood portion 22.

Here, the initial position is a position at which the lever engagement portion 34 on the main connector segment 31 fitted to the initial fitting position of the first connector 13 and the beginning end 41*a* of the connector draw-in groove 41 on the fitting operation lever 15 can be engaged each other.

Also, the temporary fixing means fixing the fixing operation lever 15 so that it cannot be rotated (the fixing operation lever is fixed) about the pivot portions 24, which are a center of rotation, in the arrow X2 direction of FIGS. 1 and 6.

The engagement release ribs 36 are integrally formed on both side surfaces of the main connector segment 31. Also, as shown in FIG. 2, the hood portion 22 of the first connector 13 is formed with notched portions 26 through which the engagement release ribs 36 can be inserted.

When the main connector segment 31 is fitted to the initial fitting position of the first connector 13, the engagement release ribs 36 are inserted into the notched portions 26 shown in FIG. 2. Then, the engagement release ribs 36 push the tips 51*a* of the lever engagement arms 51 outward, thereby disengaging the engagement between the steps 52 and the front end surfaces 22*a*. As the engagement release ribs 36 disengage the engagement between the steps 52 and the front end surfaces 22*a*, the temporary fixing of the fitting operation lever 15 by the lever engagement arms 51 is released, so that the fitting operation lever 15 can be rotated in the predetermined direction (arrow X1 direction in FIG. 10).

In this illustrative embodiment, as shown in FIG. 1, the lever engagement arms 51 are provided at the exposed positions of the outer surface of the fitting operation lever 15 so that an operator can easily see the same with naked eyes. Also, the provision positions of the notched portions 26 and the engagement release ribs 36 are set to correspond to the provision positions of the lever engagement arms 51.

Figure 8:
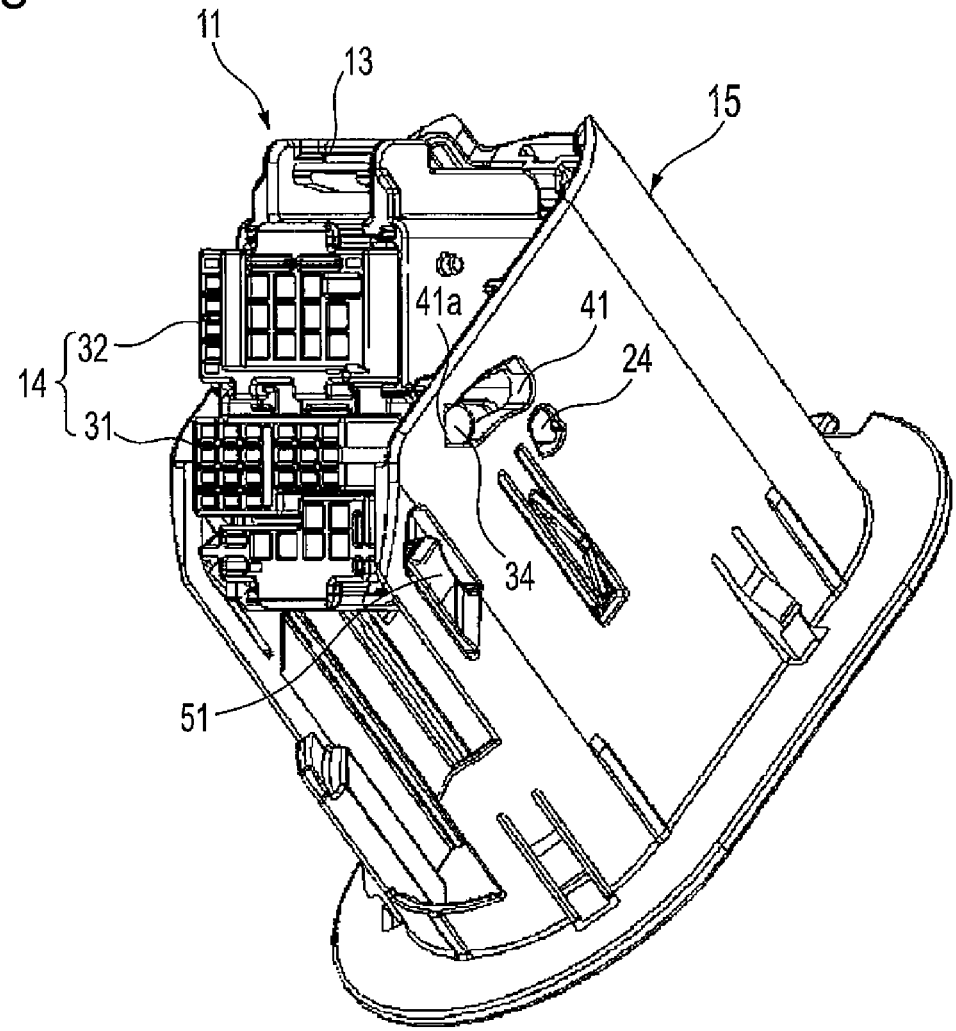
FIG. 8 is a perspective view showing a state where the second connector shown in FIG. 1 is completely fitted to the initial fitting position of the first connector.
Figure 9:
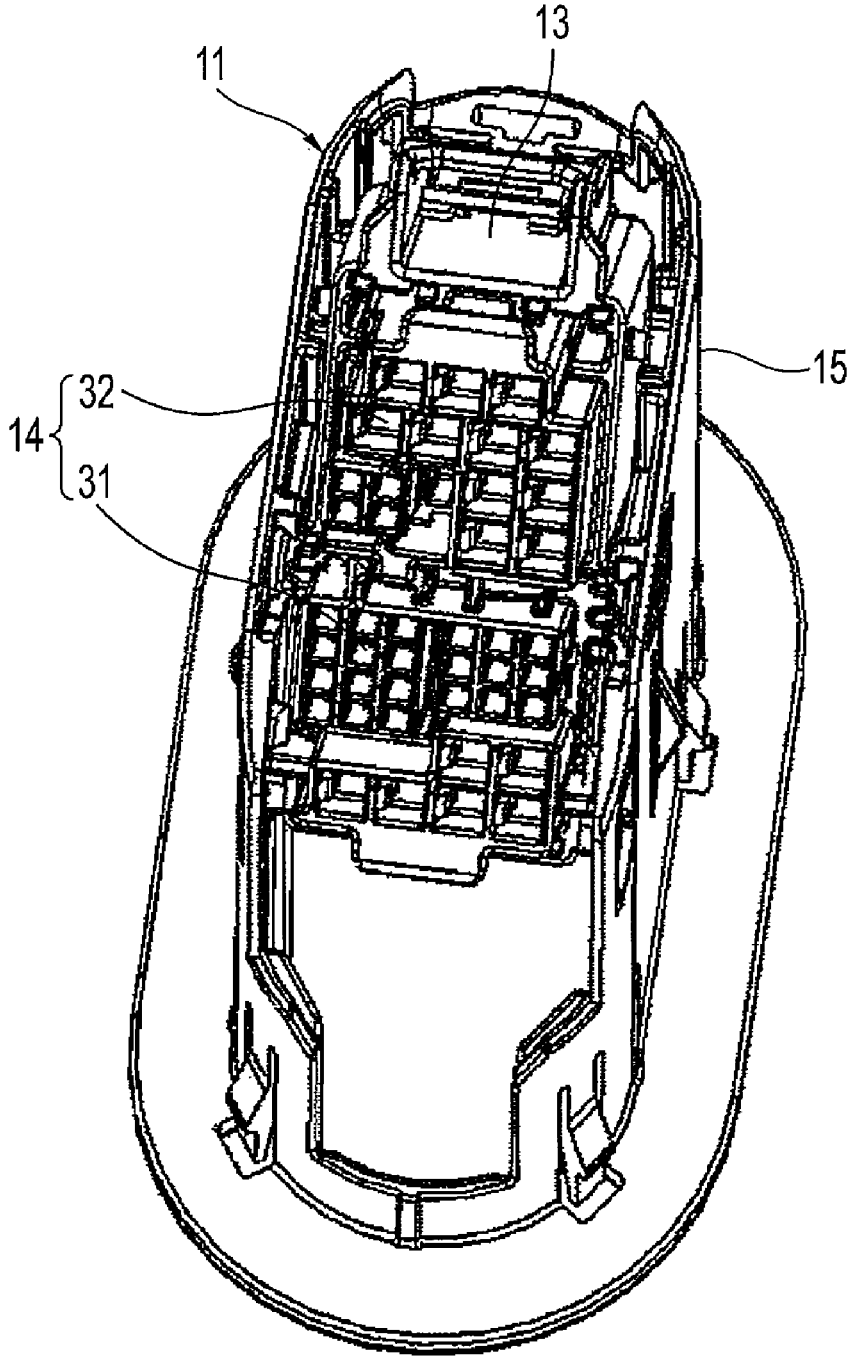
FIG. 9 is a perspective view of the lever fitting type connector of FIG. 8, which is seen from another angle.

As clearly seen from FIGS. 5 and 8, when the position of the tip 51*a* is displaced by a pressing force of the engagement release rib 36, an outward appearance of the lever engagement arm 51 is changed as the tip 51*a* is deformed.

That is, the lever engagement arms 51 are provided to the fitting operation lever 15 so that an operator can discriminate a state where the lever engagement arms are fitted to the first connector 13 to thus temporarily fix the fitting operation lever 15 at the initial position and a state where the engagement with the first connector 13 is released and the temporary fixing state is thus released, with naked eyes.

Figure 10:
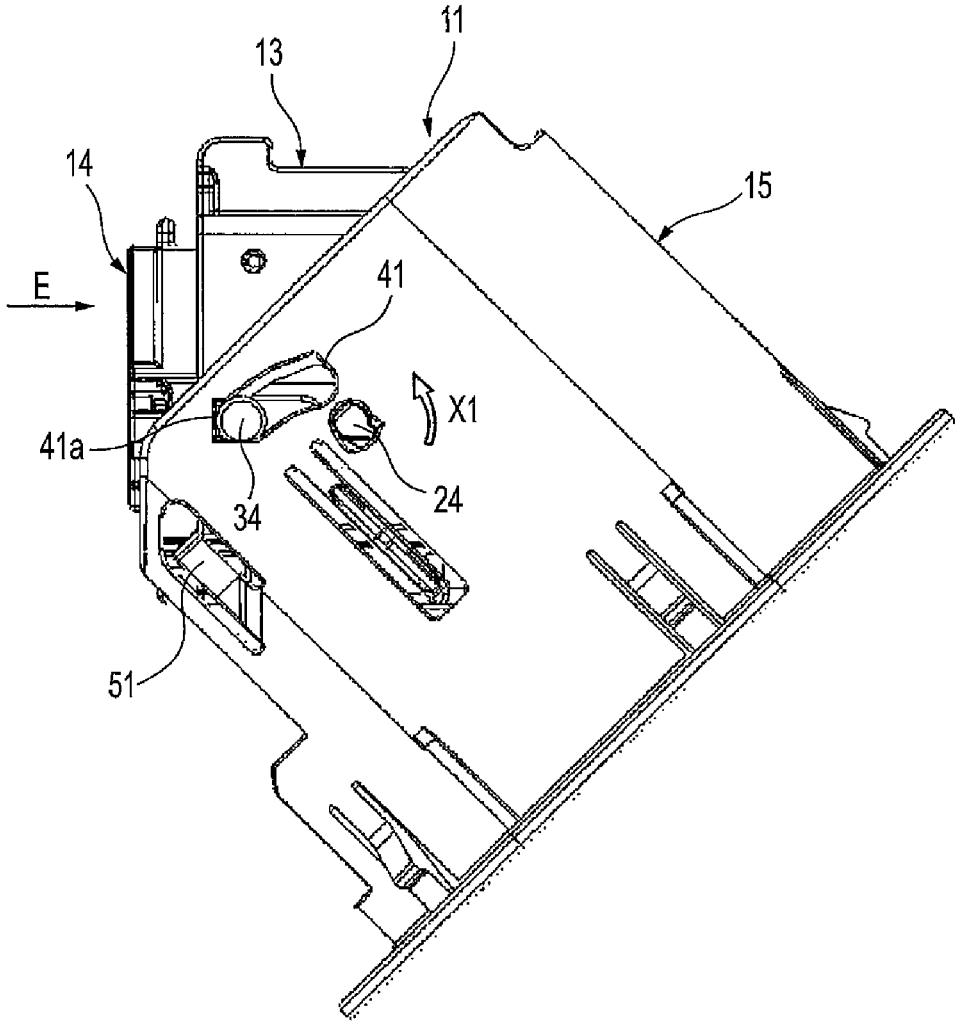
FIG. 10 is a side view of the lever fitting type connector of FIG. 8.
Figure 11:
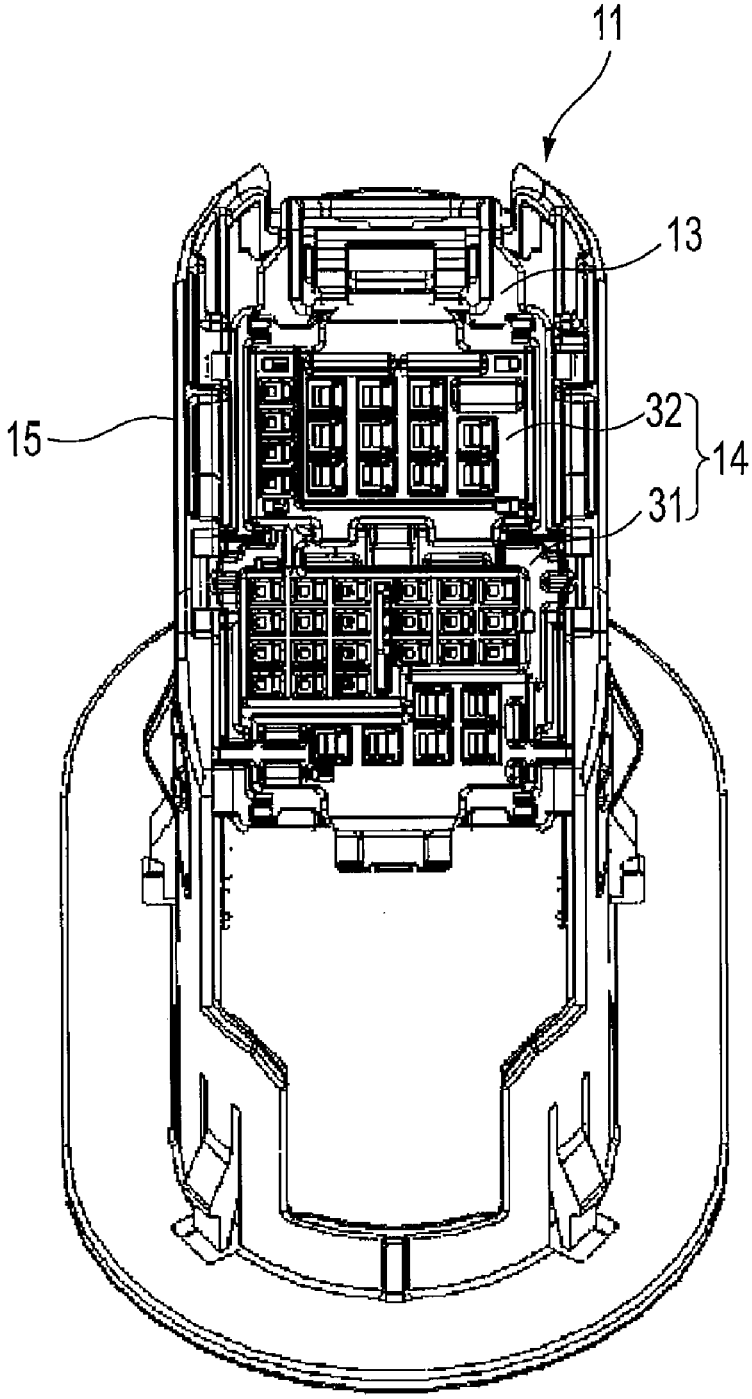
FIG. 11 is a view seen from an arrow E direction of FIG. 10.
Figure 12:
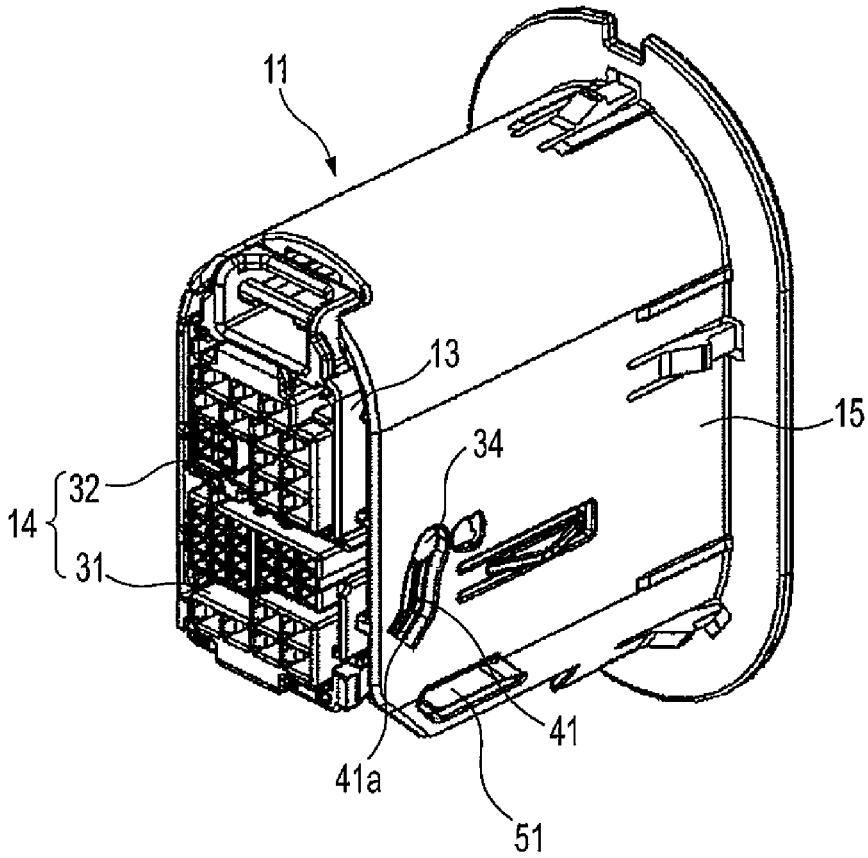
FIG. 12 is a perspective view showing a state where the fitting connection between the first connector and the second connector shown in FIG. 1 is completed.
Figure 13:
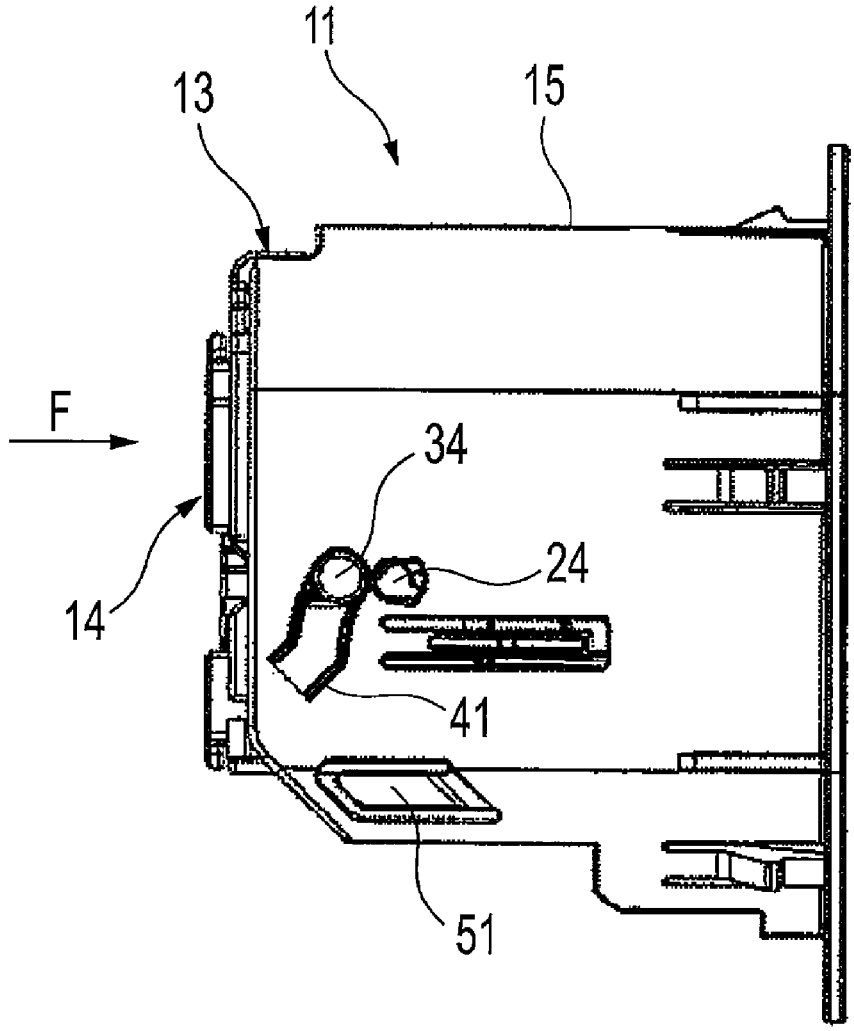
FIG. 13 is a side view of the lever fitting type connector of FIG. 12.
Figure 14:
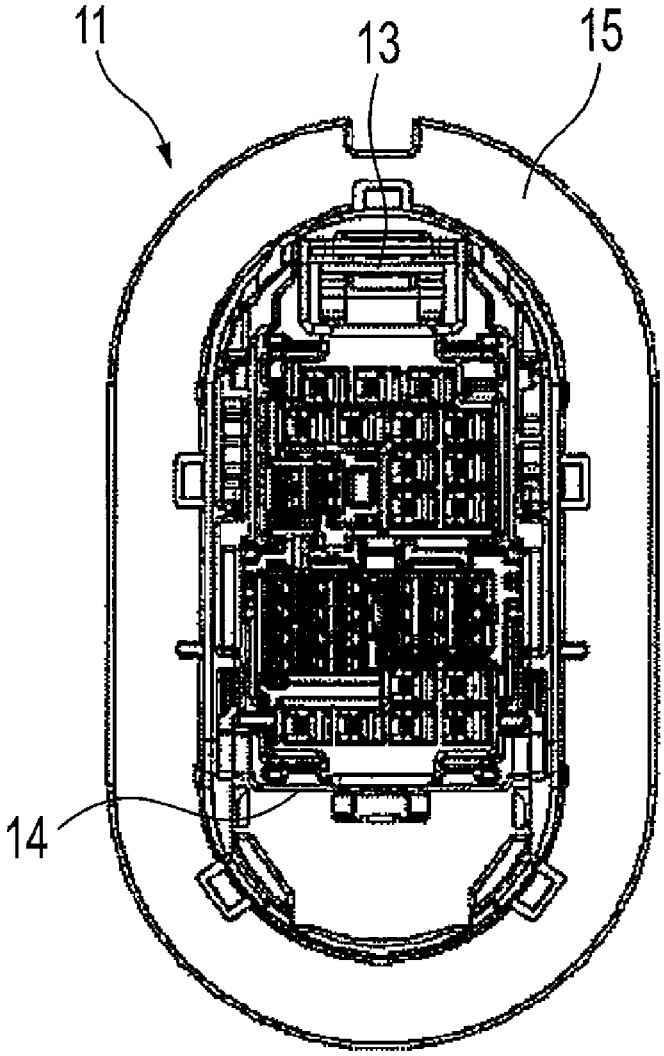
FIG. 14 is a view seen from an arrow F direction of FIG. 13.

Also, as shown in FIGS. 8 to 11, when the fitting operation lever 15 is rotated from the state where the temporary fixing of the fitting operation lever 15 is released in the arrow X1 direction of FIG. 10 by a predetermined angle, the connector draw-in grooves 41 draw the lever engagement portions 34 to terminal sides of the connector draw-in grooves 41 as the fitting operation lever 15 is rotated. Thus, as shown in FIGS. 12 to 14, the second connector 14 is moved to the complete fitting position of the first connector 13, so that the mutual fitting and connection of the connectors is completed.

Figure 16:
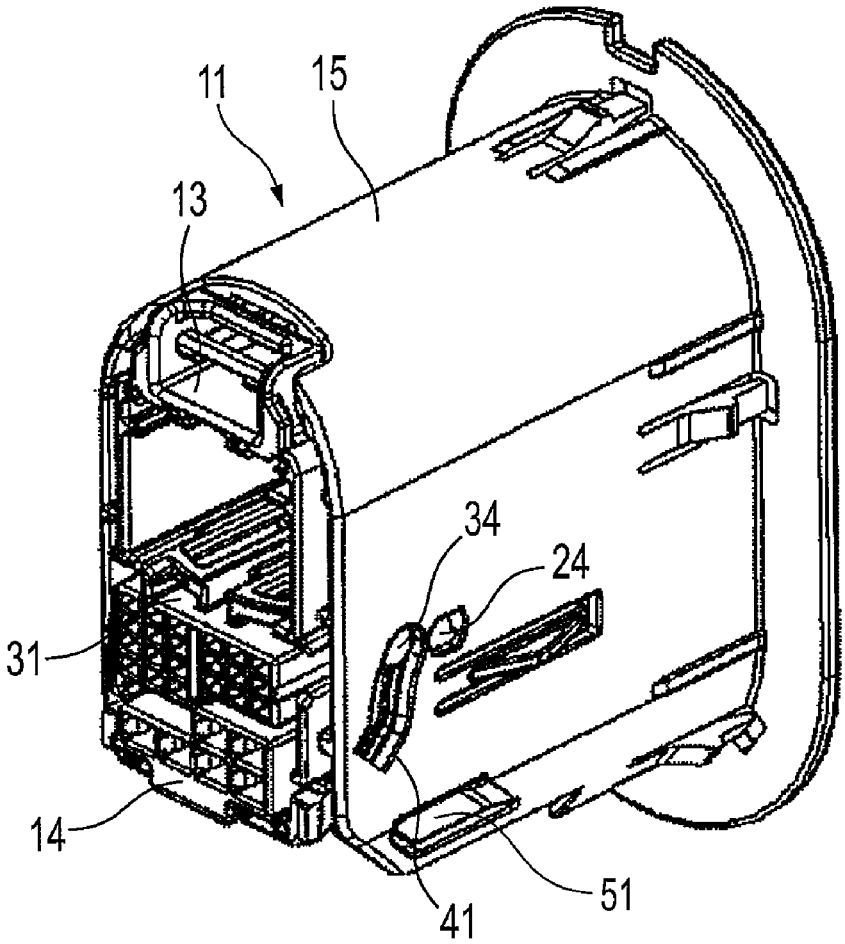
FIG. 16 is a perspective view showing a state where the connection between the first connector and the second connector of the lever fitting type connector shown in FIG. 15 is completed.
Figure 17:
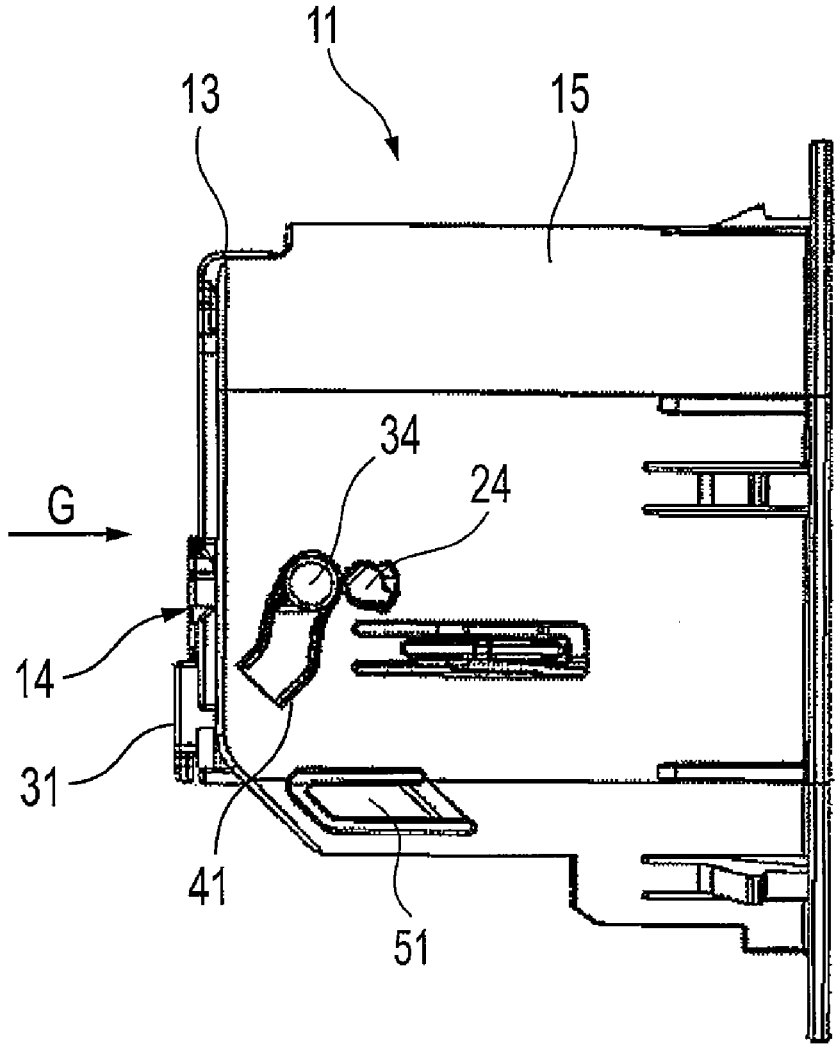
FIG. 17 is a side view of the lever fitting type connector of FIG. 16.
Figure 18:
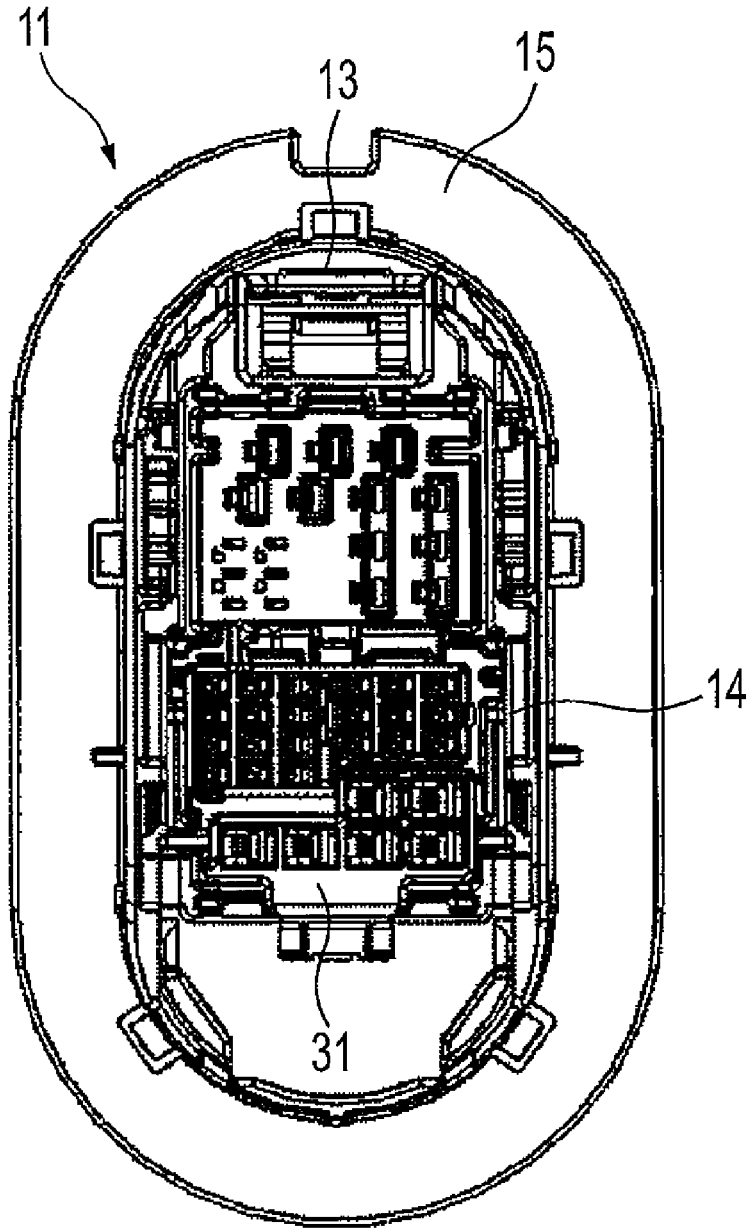
FIG. 18 is a view seen from an arrow G direction of FIG. 17.
Figure 19:
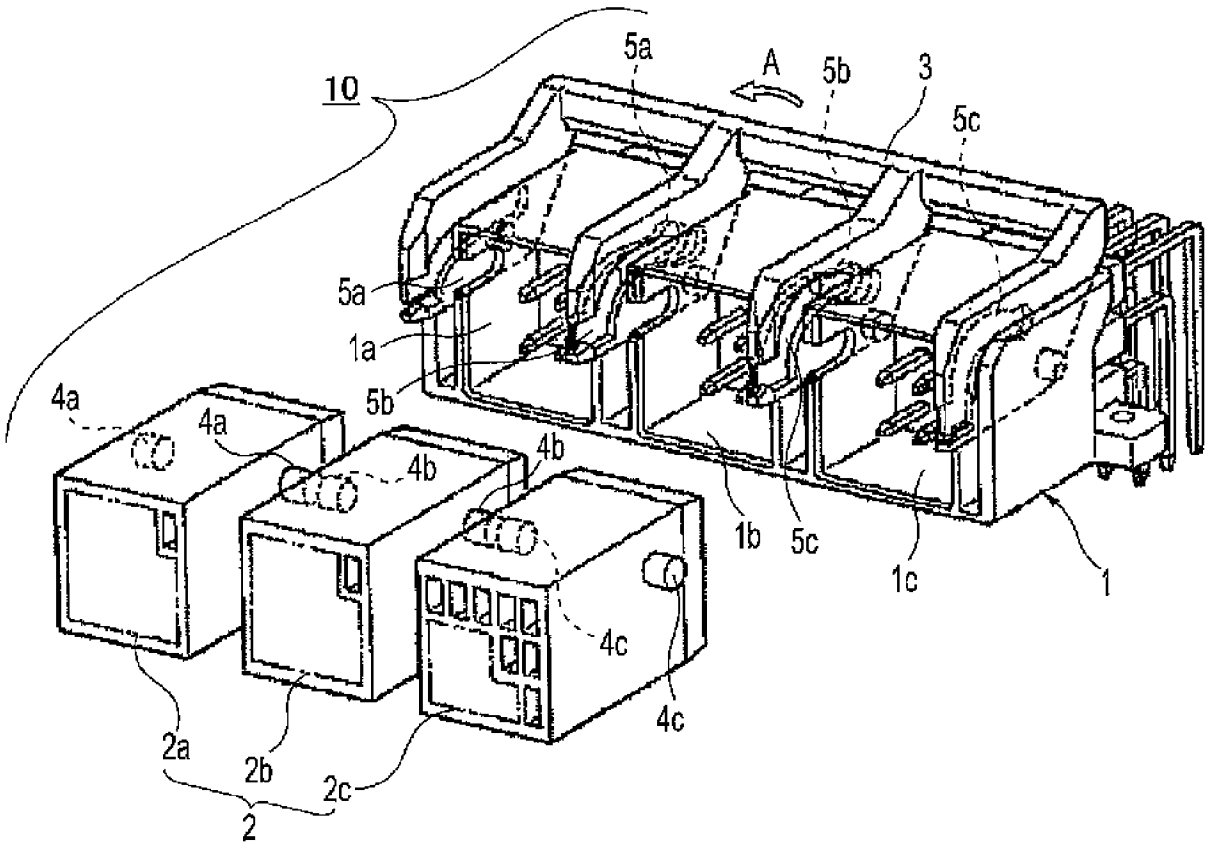
FIG. 19 is an exploded perspective view of a lever fitting type connector of the prior art.

FIG. 15 is an exploded perspective view showing a configuration where the second connector 14 consists of only the main connector segment 31 in the lever fitting type connector 11 shown in FIG. 1. Also, FIG. 16 is a perspective view showing a state where the connection between the first connector 13 and the second connector 14 of the lever fitting type connector 11 shown in FIG. 15 is completed, FIG. 17 is a side view of the lever fitting type connector 11 of FIG. 16 and FIG. 18 is a view seen from an arrow G direction of FIG. 17.

According to the lever fitting type connector 11 of this illustrative embodiment, the lever engagement portions 34 that are engaged into the connector draw-in grooves 41 of the fitting operation lever 15 and the engagement release ribs 36 for releasing the temporary fixing state of the fitting operation lever 15 are provided to the main connector segment 31.

Accordingly, when the number of core lines of a wire harness to be connected to the second connector 14 is small, for example, the subsidiary connector segment 32 may be removed and the second connector 14 consisting of only the main connector segment 31 may be used. Even in this case, a problem is not caused as regards the mutual connection of the connectors.

Also, the connector to be connected to the wire harness is comprised of only the main connector segment 31, so that it is possible to obtain a compact connector portion of the wire harness, to make the wire harness small and light and to improve the wire routing.

According to the lever fitting type connector 11 of the above illustrative embodiment, the main connector segment 31 and the subsidiary connector segment 32, which configure the second connector 14, are combined, which can be then fitted to the first connector 13, as a single connector. Therefore, it is not necessary to perform a troublesome operation of individually fitting the individual connector segments to the first connector.

Hence, it is possible to reduce the time and effort for connecting the second connector 14 consisting of the main connector segment 31 and the subsidiary connector segment 32 to the first connector 13.

Also, if the number of core lines of a wire harness is small when attaching the second connector 14 to the wire harness, it is possible to reduce an outward appearance size of the connector by removing the unnecessary subsidiary connector segment 32 of the second connector 14, as shown in FIG. 15, for example. Thereby, it is possible to obtain a compact connector portion of the wire harness.

Also, the lever fitting type connector 11 according to the above illustrative embodiment has the lever engagement arms 51 and the engagement release ribs 36. The lever engagement arms 51 temporarily fix the fitting operation lever 15, which is rotatably mounted to the first connector 13, to the initial position at which the fitting operation lever can be engaged with the lever engagement portions 34 on the main connector segment 31 fitted at the initial fitting position. Also, the engagement release ribs 36 are formed on the main connector segment 31 and release the temporary fixing of the fitting operation lever 15 by the lever engagement arms 51 when the main connector segment 31 is fitted to the initial fitting position, thereby enabling the fitting operation lever 15 to be rotated in the predetermined direction.

Accordingly, the fitting operation lever 15 on the first connector 13 is temporarily fixed at the initial position by the lever engagement arms 51 until the second connector 14 is fitted to the initial fitting position of the first connector 13, so that the fitting operation lever is prevented from being unintentionally rotated. Therefore, a case does not occur in which an operator erroneously operates the fitting operation lever 15.

When the second connector 14 is fitted to the initial fitting position of the first connector 13, the temporary fixing by the lever engagement arms 41 is released by the engagement release ribs 36 provided to the main connector segment 31 of the second connector 14. Thus, the fitting operation lever 15 engaged with the lever engagement portions 34 of the main connector segment 31 can be rotated. By rotating the fitting operation lever 15 in the predetermined direction by the predetermined angle, it is possible to move the main connector segment 31 and the subsidiary connector segment 32 combined with the main connector segment 31 from the initial fitting position of the first connector to the complete fitting position. Therefore, it is possible to smoothly fit and connect the second connector 14 and the first connector 13.

Also, according to the lever fitting type connector 11 of the above illustrative embodiment, the lever engagement arms 51 are provided so that the state where the fitting operation lever 15 is temporarily fixed at the initial position and the state where the temporary fixing state is released can be discriminated with naked eyes.

Therefore, an operator can simply discriminate whether the fitting operation lever 15 is at the state where the second connector 14 is normally fitted to the initial fitting position of the first connector 13 and the temporary fixing of the fitting operation lever 15 is thus released or at the state where the fitting of the second connector 14 to the initial fitting position is not completed yet and thus the temporary fixing state of the fitting operation lever 15 continues, by checking the status of the lever engagement arms 51 with naked eyes.

Hence, when connecting the connectors each other, the operator can easily detect that the second connector 14 is normally fitted to the initial fitting position of the first connector 13 and thus can rotate the fitting operation lever 15 at ease to thus smoothly perform the operation, just by checking the status of the lever engagement arms 51 with naked eyes without examining the insertion state of the second connector 14.

Also, the lever fitting type connector of the invention is not limited to the above illustrative embodiment and can be appropriately modified and improved. For example, in the above illustrative embodiment, the second connector consists of the two connector segments of the main connector segment and the subsidiary connector segment. However, the second connector may consist of three or more connector segments by using a plurality of subsidiary connector segments.

Although the invention has been specifically described with reference to the specific illustrative embodiments, the shapes, sizes, forms, the numbers, the arrangement positions and the like exemplified in the above illustrative embodiment are arbitrary insomuch as the purposes are realized and are not limited to the above illustrative embodiment.

This application is based on Japanese Patent Application No. 2010-137276 filed on Jun. 16, 2010, the disclosures of which are incorporated herein by reference.

INDUSTRIAL APPLICABILITY

According to the lever fitting type connector of the invention, the main connector segment and the subsidiary connector segment, which configure the second connector, are combined, which can be then fitted to the first connector, as a single connector. Therefore, it is not necessary to perform a troublesome operation of individually fitting the individual connector segments to the first connector. Hence, it is possible to reduce the time and effort for connecting the second connector consisting of the plurality of connector segments to the first connector.

Also, if the number of core lines of the wire harness is small when attaching the second connector to the wire harness, it is possible to reduce an outward appearance size of the connector by removing the unnecessary subsidiary connector segment of the second connector, for example. Thereby, it is possible to obtain a compact connector portion of the wire harness.

DESCRIPTION OF THE REFERENCE NUMERALS

11: lever fitting type connector
13: first connector
14: second connector
15: fitting operation lever
22: hood portion
22*a*: front end surface
24: pivot portion
26: notched portion
31: main connector segment (connector segment)
32: subsidiary connector segment (connector segment)
34: lever engagement portion
41: connector draw-in groove
41*a*: beginning end
51: lever engagement arm
51*a*: tip
52: step

The invention claimed is:

1. A lever fitting type connector, comprising:

a first connector;

a second connector that is configured to adjust the number of accommodation terminals by combining and separating a plurality of connector segments and is fitted and connected to the first connector, and a fitting operation lever that is rotatably provided to the first connector and moves the second connector from an initial fitting position of the first connector to a complete fitting position as the fitting operation lever is rotated in a predetermined direction by a predetermined angle at a state where the second connector is fitted at the initial fitting position, wherein the second connector comprises:

a main connector segment that has a lever engagement portion, which is engaged with the fitting operation lever when the main connector segment is fitted to the initial fitting position, and is moved from the initial fitting position to the complete fitting position by an operation for rotating the fitting operation lever, and a subsidiary connector segment that is detachably combined with the main connector segment and is moved from the initial fitting position to the complete fitting position together with the main connector segment, and wherein the lever fitting type connector further comprises:

a lever engagement arm that temporarily fixes the fitting operation lever rotatably mounted to the first connector to an initial position at which the fitting operation lever can be engaged with the lever engagement portion on the main connector segment fitted at the initial fitting position, and an engagement release rib that is integrally formed with the main connector segment and releases the temporary fixing of the fitting operation lever by the lever engagement arm when the main connector segment is fitted to the initial fitting position, thereby enabling the fitting operation lever to be rotated in the predetermined direction.

2. The lever fitting type connector according to claim 1, wherein the lever engagement arm is provided so that a state where the fitting operation lever is temporarily fixed at the initial position and a state where the temporary fixing state is released can be discriminated with naked eyes.

* * * * *